United States Patent [19]

Kullendorff et al.

[11] 4,378,206

[45] Mar. 29, 1983

[54] FLUIDIZED BED COMBUSTION APPARATUS AND METHOD OF OPERATION

[75] Inventors: Anders Kullendorff, Åby; Sture Schön, Finspong, both of Sweden

[73] Assignee: STAL-LAVAL Turbin AB, Västeras, Sweden

[21] Appl. No.: 74,461

[22] Filed: Sep. 11, 1979

[30] Foreign Application Priority Data

Sep. 12, 1978 [SE] Sweden ..... 7809559

[51] Int. Cl.[3] ..... F23D 19/00

[52] U.S. Cl. ..... 431/170; 431/328; 110/263; 432/58

[58] Field of Search ..... 431/7, 170, 328; 432/58, 14, 15; 34/57 A; 110/245, 263, 264, 265; 122/4 D

[56] References Cited

U.S. PATENT DOCUMENTS

| | | | |
|---|---|---|---|
| 1,026,121 | 5/1912 | Pictet | 431/7 |
| 2,918,118 | 12/1959 | Schirmer | 431/328 |
| 3,048,153 | 8/1962 | Abrahamsen | 122/4 D |
| 3,508,506 | 4/1970 | Bishop | 122/4 DX |
| 3,799,747 | 3/1974 | Schmalfeld et al. | 110/245 |
| 3,810,732 | 5/1974 | Koch | 431/7 |
| 3,881,857 | 5/1975 | Hoy et al. | 431/7 |
| 3,914,089 | 10/1975 | Desty et al. | 431/7 |
| 3,923,447 | 12/1975 | Desty et al. | 431/328 |
| 3,957,419 | 5/1976 | McKenzie | 431/170 |
| 3,958,916 | 5/1976 | Barker et al. | 431/170 |
| 3,996,863 | 12/1976 | Osborn | 110/245 |
| 4,055,390 | 10/1977 | Young | 432/14 |
| 4,148,437 | 4/1979 | Barker et al. | 431/170 X |
| 4,165,040 | 8/1979 | Beacham et al. | 431/170 X |
| 4,204,829 | 5/1980 | Kendall et al. | 431/328 |
| 4,244,305 | 1/1981 | Kawano et al. | 110/245 |

*Primary Examiner*—Samuel Scott
*Assistant Examiner*—Randall L. Green
*Attorney, Agent, or Firm*—Pollock, Vande Sande & Priddy

[57] ABSTRACT

A fluidized bed combustion chamber (3) is provided with a perforated bottom plate (4) into which air nozzles (18, 19) are pressed in a manner similar to that used for tubes in a tube sheet of a heat exchanger. About one-third of the nozzles (18) are connected to a startup or auxiliary combustion chamber (14) for blowing in hot gas for heating the bed to the flash-point or ignition temperature of the fuel. Further, the bottom plate is insulated (20) between the nozzles. (FIGS. 1, 4.) A method of operating such a combustion chamber also is disclosed.

13 Claims, 6 Drawing Figures

Fig. 3
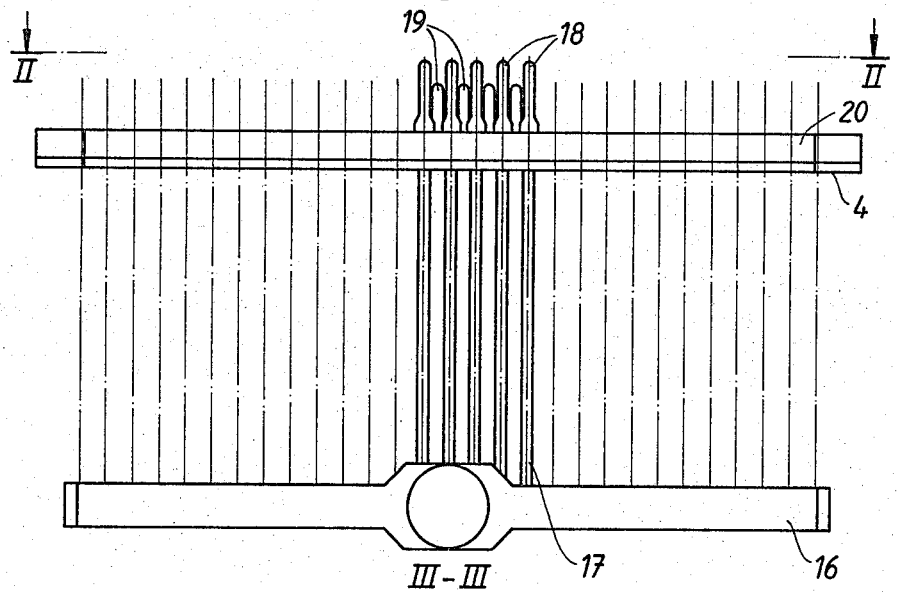
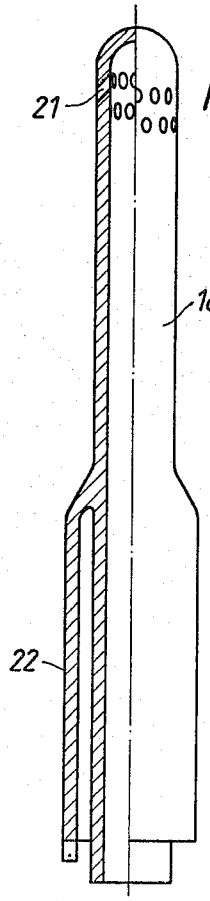
Fig. 5
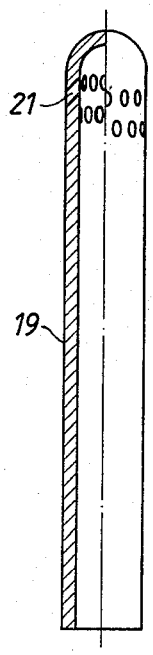
Fig. 6

FLUIDIZED BED COMBUSTION APPARATUS AND METHOD OF OPERATION

DESCRIPTION

1. Technical Field

The present invention relates to combustion chambers of the type comprising a fluidized bed. Such a combustion chamber may, for example, be intended for use with a gas turbine. A fluidized bed substantially comprises an enclosure having a perforated bottom plate on which the bed material rests when the bed is not in operation. Air is blown upward through the bottom plate to lift and fluidize the bed material and also to support combustion in the bed.

2. Background Art

In its simplest from, the bottom plate may comprise a simple perforated plate. This is not practical, however, because, among other things, the bed material will then easily fall through the plate during a shutdown period. Instead it has been proposed to introduce the air through nozzles in the plate; but in prior art constructions, these nozzles have been relatively complicated.

DISCLOSURE OF INVENTION

According to the present invention a simpler construction is achieved. Prefabricated nozzles of preferably cylindrical geometry are simply pressed into round holes in the bottom plate. To prevent the nozzles from becoming detached due to heating of the plate when the bed material settles after operation, the plate can suitably be insulated between the nozzles, thereby also protecting the plate against overheating.

Combustion in the bed is started by heating the bed material using hot gas blown through the bed from an auxiliary or startup combustion chamber. This gas usually flows along the same path as the combustion air. If liquid fuel is used, it is normally sufficient to heat the bed to the flash-point of the fuel, whereafter the fuel may be ignited by an intense flame or an electric spark. The process is even more simple if, for some reason, it is desirable to burn gaseous fuel, in which case preheating of the bed usually is not required, at least in principle.

If solid fuel is used, the bed has to be heated to the auto-ignition temperature of the fuel, which normally is considerably higher than that required for liquid fuel; however, this approach involves a complication since a special startup combustion chamber normally will still be needed. The most simple thing is therefore to heat the bed by means of said startup combustion chamber until the auto-ignition temperature of the solid fuel is reached.

The combined hot gas and combustion air nozzles will be heated to a high temperature; therefore, according to a further aspect of the invention, only some of the nozzles are connected to the startup combustion chamber, these startup nozzles being evenly distributed over the bottom plate. These startup nozzles are configured with special regard to temperature stresses.

BRIEF DESCRIPTION OF DRAWINGS

The invention will be described with reference to the accompanying drawings, in which:

FIG. 3 shows a section taken on line III—III of FIG. 2;

FIG. 5 shows an elevation view, partly in section, of a combined hot gas and combustion air nozzle according to the invention; and FIG. 6 shows an elevation view, partly in section, of a combustion air nozzle according to the invention.

BEST MODE FOR CARRYING OUT THE INVENTION

Figure 1:
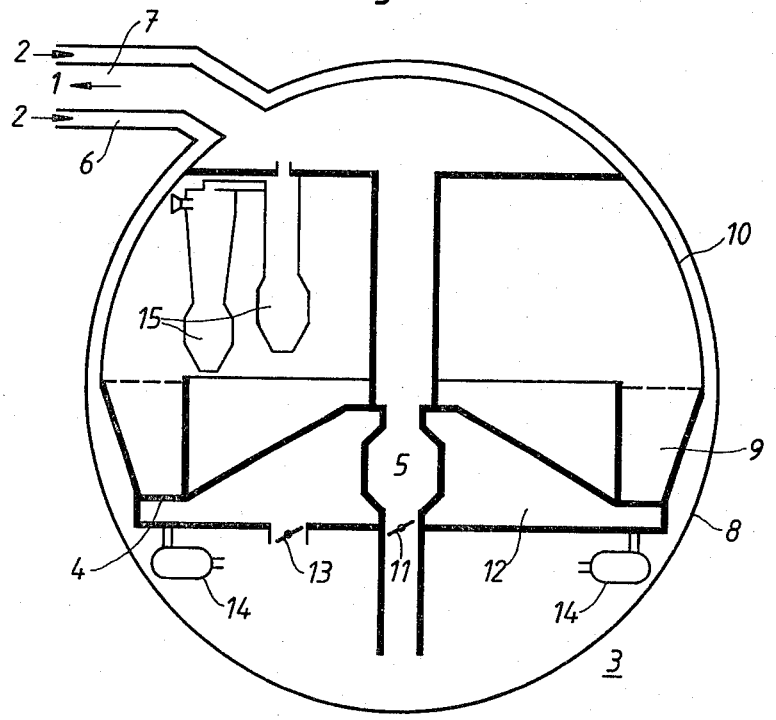
FIG. 1 shows an example of a fluidized bed of the general type in which the invention is used.

FIG. 1 shows a combustion chamber 3 of a known type. A current 2 of compressed air enters an outer tube 6 and the hot combustion gases 1 are discharged through an inner, coaxial tube 7. A special startup combustion chamber 5 may be located in the middle of the main combustion chamber. The combustion chamber is essentially spherical and comprises an outer casing 8, capable of confining gas under pressure. The fluidized bed 9 is annular and arranged in a chamber inside said casing 8. The incoming compressed air from conduit 6 flows between outer casing 8 and an inner casing 10 which forms an enclosing roof over the fluidized bed. The compressed air is passed down to the bottom of the combustion chamber, from where it is distributed to the various parts of the combustion chamber.

Startup combustion chamber 5 is in a parallel flow path to the main combustion chamber and is intended for starting a gas turbine, driven by the hot gases leaving combustion chamber and for this purpose is provided with a regulating and cut-off valve 11. Below fluidized bed 9 a distributing chamber 12 is provided for directing combustion air to the fluidized bed. Air flowing to distributing chamber 12 can be conducted either through one or more regulating and cut-off valves 13, or through auxiliary combustion chambers 14 to provide hot air for heating the fluidized bed. Auxiliary combustion chambers 14 typically are also provided with regulating and cut-off valves (not shown). Above fluidized bed 9 there are arranged a number of two-stage cyclones 15 which remove accompanying ashes and bed material from the hot combustion gases before the gases are forwarded to the tube 7.

To start the combustion process in fluidized bed 9, valve 11 of the special startup combustion chamber 5 is opened at the same time as liquid or gaseous fuel is passed to a spreader (not shown) located within the startup combustion chamber. Valves 13 leading to distributing chamber 12 are then closed. After combustion chamber 5 has ignited or while ignition in chamber 5 is starting, the valves leading to auxiliary combustion chambers 14 can be opened and fuel ignited in chambers 14, for heating fluidized bed 9. Like starting combustion chamber 5, combustion chambers 14 work with liquid or gaseous fuel. The hot gases from auxiliary combustion chambers 14 must have a sufficient temperature to heat fluidized bed 9 and a sufficient mass flow rate to lift up and fluidize the bed. When the bed material has reached the ignition temperature for the fuel used, normally 700°–900° C., fuel can be supplied to the bed. At the same time, valves 13 start opening to increase the air flow. When combustion has been established in the fluidized bed, combustion in chambers 5 and 14 can be extinguished; and valve 11 for the chamber 5, closed.

Figure 2:
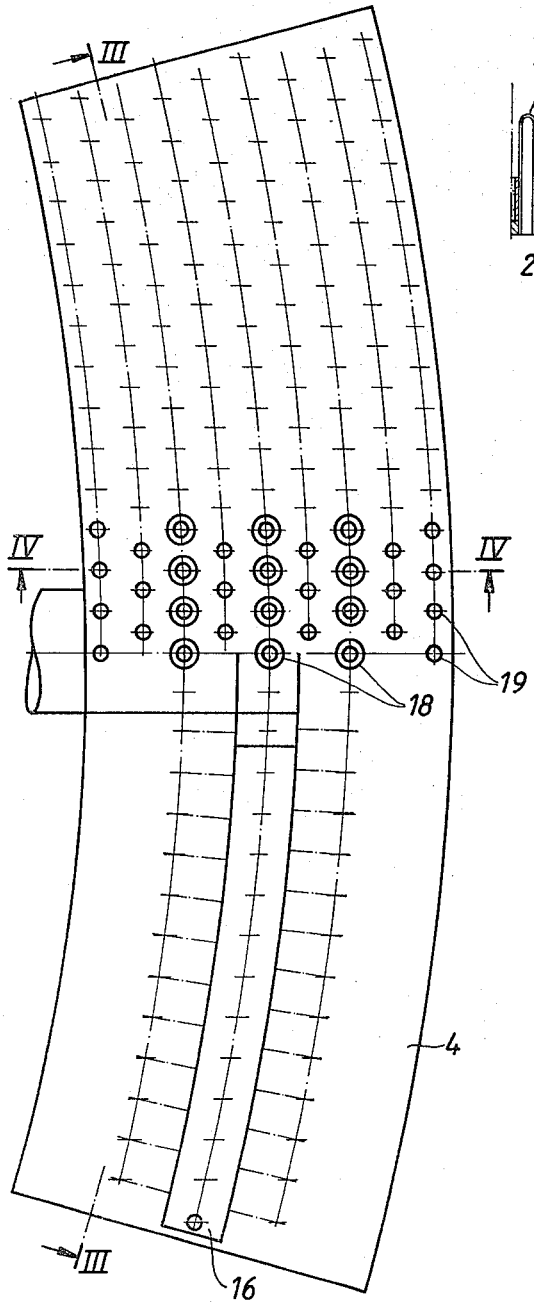
FIG. 2 shows a schematic plan view of a bottom plate embodying the invention.
Figure 4:
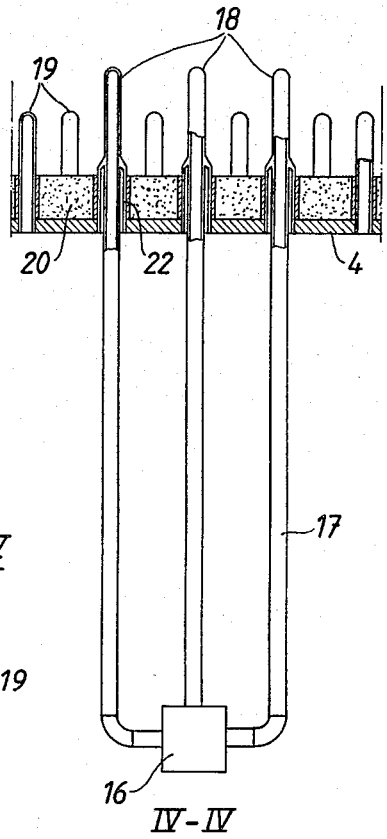
FIG. 4 shows a section taken on line IV—IV of FIG. 2.

FIGS. 2 to 4 show the annular bottom plate 4 according to the invention as seen from above and in radial and peripheral directions. However, the invention is not limited to an annular fluidized bed but can also be applied to fluidized beds of other shapes. A number of nozzles are pressed into the plate 4 to supply startup air, combustion air or both to the fluidized bed. Instead of connecting combustion chambers 14 directly to distributing chamber 12, as in the known system of FIG. 1, the chambers 14 are connected, through distributing conduits such as headers or boxes 16 and tubes 17, to a plurality of special startup nozzles 18 which are evenly distributed among a plurality of ordinary nozzles 19. Thus, the hot gases from combustion chamber 14 are isolated from distributing chamber 12 and plate 4. To obtain the required heating of bed 9 during startup, startup nozzles 18 preferably make up approximately one third of all the nozzles. By means of openings (not shown), distributing boxes 16 can be directly connected to distributing chamber 12 in FIG. 1 so that nozzles 18 and 19 during normal operation operate completely in parallel.

To protect plate 4 and the attachment of the nozzles against the heat from the bed, particularly when the bed settles during shutdown, plate 4 is suitably provided with an insulating layer 20. Further, to protect the ordinary nozzles 19 during the heating of the bed, starting nozzles 18 preferably are longer than the ordinary nozzles, so that hot gases leaving nozzles 18 during startup do not unduly influence the ordinary nozzles. When combustion in the fluidized bed has been established, it will probably spread all the way down to insulating layer 20, but all the nozzles are then protected by the cooling of the blown-in combustion air.

The structure of nozzles 18 and 19 is shown by FIGS. 5 and 6, respectively. Both types are essentially cylindrical, closed at their upper ends and provided with air holes 21 through their vertical sides. To prevent the bed material from running into the nozzles, holes 21 are directed obliquely downwards. The nozzles may suitably be cast, for example from annealed casting or the like. The nozzles are suitably pressed into corresponding holes in plate 4, in a manner similar to the tubes in a tube sheet of a heat exchanger. For the ordinary nozzles 19, temperature effects are not a problem since they are well cooled by the blown-in air and insulated at their lower ends by layer 20. The startup nozzles 18, on the other hand, are heated by the hot gas used during startup for the heating of the bed; and therefore, the attachment of the startup nozzles must be protected from the heat so that they do not loosen. According to the invention, this protection is provided by making the startup nozzles double-walled, as shown in FIG. 5. The outer concentric wall 22 is then well separated from the hot inner wall. In some applications, an insulating layer between the two walls of the tube may be desirable.

Industrial Applicability

Fluidized beds embodying the present invention are especially suited for use as a hot gas source for a gas turbine; however, the principles of the claimed invention may also be applied to fluidized beds used for other purposes such as refuse disposal, chemical processes and the like.

We claim:

1. A fluidized bed combustion apparatus, comprising:
a fluidized bed having a bottom plate;
a plurality of nozzles extending through said bottom plate for blowing gases into said fluidized bed;
a plenum below said bottom plate for distributing air to a first portion of said nozzles;
at least one auxiliary combustion chamber for generating hot gases; and
distribution conduit means arranged within said plenum for directing hot gases generated in said auxiliary combustion chamber from said auxiliary combustion chamber to a second portion of said nozzles for heating said fluidized bed when starting combustion therein, whereby said hot gases are isolated from said plenum and said bottom plate by said distribution conduit means, each of said second portion of said nozzles comprising an outer, concentric sleeve for attachment to said bottom plate, said sleeve being joined at its upper end to its associated nozzle, whereby said associated nozzle is separated from said plate by said sleeve.

2. Apparatus according to claim 1, wherein said second portion of said nozzles is evenly distributed among said plurality of nozzles.

3. Apparatus according to claim 1, further comprising a layer of insulation on the upper side of said bottom plate between said nozzles.

4. Apparatus according to claim 1, wherein each of said plurality of nozzles is closed at its upper end and provided with a plurality of downwardly, obliquely directed holes through its side walls.

5. Apparatus according to claim 1, wherein said second portion of said nozzles comprises about one third of said plurality of nozzles.

6. Apparatus according to claim 1, further comprising means for directing air through all of said plurality of nozzles during normal operation.

7. Apparatus according to claim 1, wherein each of said second portion of said nozzles extends further into said fluidized bed than the rest of said plurality of nozzles.

8. A fluidized bed combustion apparatus, comprising:
a fluidized bed having a bottom plate;
a plurality of nozzles extending through said bottom plate for flowing gases into said fluidized bed, each of said plurality of nozzles being closed at its upper end and provided with a plurality of downwardly, outwardly and obliquely directed holes through its side walls;
a plenum below said bottom plate for distributing air to a first portion of said nozzles;
at least one auxiliary combustion chamber for generating hot gases; and
distribution conduit means arranged within said plenum for directing hot gases generated in said auxiliary combustion chamber from said auxiliary combustion chamber to a second portion of said nozzles for heating said fluidized bed when starting combustion therein, whereby said hot gases are isolated from said plenum and said bottom plate by said distribution conduit means.

9. Apparatus according to claim 8, wherein said second portion of said nozzles is evenly distributed among said plurality of nozzles.

10. Apparatus according to claim 8, further comprising a layer of insulation on the upper side of said bottom plate between said nozzles.

11. Apparatus according to claim 8, wherein said second portion of said nozzles comprises about one third of said plurality of nozzles.

12. Apparatus according to claim 8, further comprising means for directing air through all of said plurality of nozzles during normal operation.

13. Apparatus according to claim 8, wherein each of said second portion of said nozzles extends further into said fluidized bed than the rest of said plurality of nozzles.

* * * * *